United States Patent [19]

Zaba

[11] 4,380,147

[45] Apr. 19, 1983

[54] STEAM POWER PLANT CONTAINING PRESSURE-FIRED STEAM GENERATOR WITH FLUIDIZED BED FIRING

[75] Inventor: Tadeusz Zaba, Ennetbaden, Switzerland

[73] Assignee: BBC Brown, Boveri & Co. Ltd., Baden, Switzerland

[21] Appl. No.: 245,075

[22] Filed: Mar. 18, 1981

[30] Foreign Application Priority Data

Apr. 16, 1980 [EP] European Pat. Off. ..... 80200338.4

[51] Int. Cl.³ ..... F02C 6/18

[52] U.S. Cl. ..... 60/39.182; 60/39.464

[58] Field of Search ..... 60/39.12, 39.18 B, 39.46 S; 122/4 D, 7 R

[56] References Cited

U.S. PATENT DOCUMENTS 3,396,781 8/1968 Whetmore ..... 122/7 R
4,287,023 9/1981 Cooper ..... 202/228
4,338,074 7/1982 Johansson ..... 122/4 D

FOREIGN PATENT DOCUMENTS 2733931 1/1979 Fed. Rep. of Germany .
52-18501 2/1977 Japan .

*Primary Examiner*—L. J. Casaregola
*Attorney, Agent, or Firm*—Werner W. Kleeman

[57] ABSTRACT

A steam power plant containing a pressure-fired steam generator with fluidized bed firing and a loading or charging set or unit driven by the flue gases of the firing equipment. The boiler heating surfaces are arranged exclusively outside of the vortex or fluidized layer of the fluidized bed. In the steam generator there are provided by-pass flow regulating valves for controlling and regulating the steam output. For this purpose and for cooling the fluidized or vortex layer there is additionally provided a flue gas by-pass or shunt line containing at least one by-pass regulation valve, a flue gas cooler and a ventilator.

1 Claim, 1 Drawing Figure

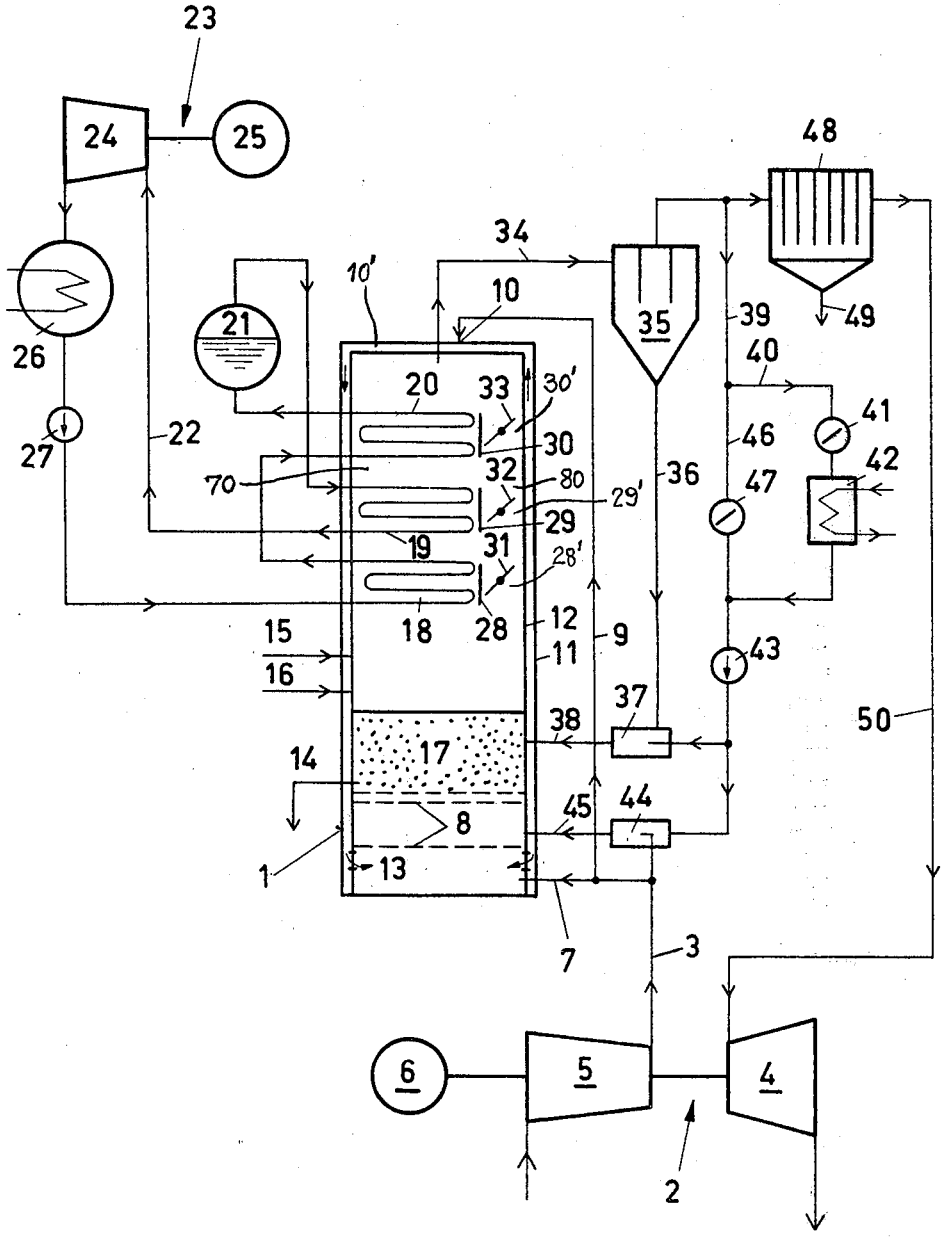
23
24
25
48
34
10'
10
35
39
49
26
21
40
20
33
30'
41
27
22
30
46
42
70
32
80
36
47
29'
29
19
31
28'
18
28
12
15
9
43
16
11
37
38
50
14
17
45
44
8
1
13
7
3
6
5
4
2

STEAM POWER PLANT CONTAINING PRESSURE-FIRED STEAM GENERATOR WITH FLUIDIZED BED FIRING

BACKGROUND OF THE INVENTION

The present invention relates to a new and improved construction of steam power plant containing a pressure-fired stem generator or steam-generating unit with fluidized bed firing.

Generally speaking, the steam power plant of the present development is of the type containing a loading or charging set or group composed of a gas turbine and a compressor, driven by the flue gases of the steam generator. The loading set feeds the compressed combustion air below the fluidized bed, in order to form thereof a fluidized or vortex layer or flow. Additionally, there are provided devices for the separation, filtering and withdrawal of the dust-like contaminants contained in the flue gases and for controlling and regulating the steam output or capacity delivered to the steam turbogenerator set.

With heretofore known pressure-fired steam generators containing fluidized bed firing the heat of combustion is transmitted for the most part to the water tubes located in the fluidized or vortex layer of the fluidized bed firing arrangement, in order to achieve cooling of the vortex layer fluidized bed and to obtain an optimum combustion temperature.

A decisive drawback of such steam generators resides in the fact that owing to the high temperatures the tubes located in the vortex layer are subjected to corrosion attack by the combustion gases, and thus, must be replaced in a relatively short amount of time.

Instead of having cooling tubes arranged in the vortex layer or flow the heat of combustion of the vortex layer also can be withdrawn by having an increased air throughput. However, this is associated with the drawback that then the turbine must handle a larger volume of flue gas and the load or charging set and equally the filter must be dimensioned to be correspondingly larger.

SUMMARY OF THE INVENTION

Therefore, with the foregoing in mind it is a primary object of the present invention to provide a new and improved construction of steam power plant containing a pressure-fired steam generator with fluidized bed firing which is not associated with the aforementioned drawbacks and limitations of the prior art constructions.

Another and more specific object of the present invention aims at avoiding the previously discussed drawbacks and additionally devising a steam power plant containing pressure-fired steam generator, which is capable of operating at good efficiencies, possesses good regulatability and is economical to operate.

Now in order to implement these and still further objects of the invention, which will become more readily apparent as the description proceeds, the steam power plant of the present development is manifested by the features that all of the boiler heating surfaces are arranged externally of the vortex layer of the fluidized bed. The devices for controlling and regulating the steam output comprise by-pass regulation valves for the flue gas which are arranged in the steam generator and a flue gas by-pass line arranged following the steam generator and branching-off of the flue gas line. In the flue gas by-pass or auxiliary line there are arranged a flue gas by-pass valve, a flue gas cooler and a ventilator or fan. The flue gas by-pass line opens into the steam generator below the fluidized bed.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing shows in schematic view a steam power plant containing a pressure-fired steam generator with fluidized bed firing according to the invention.

DETAILED DESCRIPTION OF THE PREFERRED EMBODIMENTS

Describing now the drawing, a steam generator or steam-generating unit 1 has infed thereto the combustion air from a loading or charging set or group 2 under pressure, for instance at 8 to 10 bar, by means of a primary air line or conduit 3 along different paths. The loading group 2 comprises a gas turbine 4 driven by the flue gases of the steam generator 1 and having an open circulation, a compressor 5 rigidly coupled with the gas turbine 4, and a starting motor 6 serving for the start-up operation, this starting motor 6 being disconnected after reaching the static operating condition of the installation.

Branching-off of the primary air line or conduit 3 is an air infeed line 7, by means of which the air is delivered beneath a perforated inflow floor or bottom 8 constituting the fluidized bed grate. The throughflowing air acts as a carrier flow for the fuel particles which thus are held in suspension and form the fluidized bed or vortex layer. A further part of the combustion air is branched-off from the line 7 by a cooling air line 9 and at the infeed location 10 is infed into a cooling air chamber of space 10' bounded by the outer shell or jacket 11 and the inner shell or jacket 12 of the steam generator 1. The thus infed portion of the combustion air is delivered from the cooling air chamber 10', by means of ports or slots 13 or equivalent structure provided at the inner shell 12 below the inflow base or floor 8, to a location beneth such inflow base or floor 8.

At the left-hand side of the steam generator 1 there have been symbolically indicated the ash removal device 14, the coal or other fuel infeed device 15 and the additive infeed device 16, by means of which there can be admixed in conventional manner to the coal or carbon fluidized bed or layer an additive, such as for instance limestone or dolomite, in order to neutralize the sulphur compounds. The fluidized bed has been conveniently designated by reference charcter 17.

The flue gases flow within the boiler draft or flue pass 70 past a pre-evaporator bundle of tubes 18, a superheater bundle of tubes 19 and an evaporator bundle of tubes 20. A steam collector 21 is arranged externally of the flue gas pass or draft 70, in the flow direction of the boiler water, after the cluster or bundle of evaporator tubes 20. The steam which has been separated-out in the steam collector 21 arrives at the cluster or bundle of superheater tubes 19 and further, by means of a steam line 22, at a steam turbine 24 of a steam turbo-generator set or assembly 23, the generator 25 of which supplies the network current. The waste steam effluxing from the turbine 24 is delivered to a condenser 26, from which a feedwater pump 27 conveys the condensate into the cluster or bundle of pre-evaporator heating tubes 18.

Located parallel to the flue gas pass or draft 70, in which there are arranged the three steam heating surfaces constituted by the respective bundle of tubes 18, 19 and 20, is a by-pass or shunt flue gas channel, generally indicated by reference character 80, which is separated by the partition or separation walls 28, 29 and 30 in relation to the flue gas pass 70. These partition walls 28, 29 and 30 form three short channels 28', 29' and 30', respectively. The provision of a respective by-pass flow regulating valve 31, 32 and 33, here shown as flap members, within such channels 28', 29' and 30', enables controlling or regulating in fine increments or stages the flow of the flue gas through the individual portions of the flue gas pass 70 containing the three heating surfaces 18, 19 and 20 individually or in selected combinations, and thus, in conjunction with further regulating elements to be described more fully hereinafter, to accommodate in fine increments or steps the steam output and also the temperature of the flue gases following the boiler to the momentary requirements.

The flue gases depart from the steam generator 1 and arrive by means of a flue gas withdrawal line 34 at a cyclone dust separator 35 where there are eliminated a greater part of the non-combusted dust-like constituents. These are withdrawn along with a portion of the flue gas by means of a dust return line 36 and fed to an injector 37 which blows them through a dust infeed line 38 into the fluidized bed 17.

As to the remaining, partially dedusted flue gas a portion arrives at a by-pass flow regulation circuit composed of a flue gas by-pass line 39, 40, a flue gas by-pass flow valve 41, a flue gas cooler or cooling device 42 and a ventilator or fan 43. When the valve 41, here shown as a flap valve, is in its open position the flue gas is partially delivered by the ventilator 43 into the injector 37 for the aforementioned blowing-in of the dust by means of the line 38 into the fluidized bed 17 and partially into a flue gas/air mixer 44. In the flue gas/air mixer 44 the flue gas is admixed with the combustion air branched-off from the line 3 in such a ratio and infed by means of a line 45 below the fluidized bed 17 so that the temperature of the vortex layer or fluidized bed in conjunction with the other regulation possibilities can be maintained at an optimum value.

Water predominatly comes into consideration as the cooling agent or coolant for the flue gas cooling device 42. This water, owing to the relatively high flue gas temperature, which for instance can still amount to 500° C., can be utilized for generating steam, for instance work or heating steam or also however for superheating the turbine steam.

Branching-off of the flue gas by-pass flow line or line means 39, 40 forwardly of the flue gas by-pass flow valve 41 is a secondary by-pass flow line 46. In the secondary by-pass flow line 46 there is provided a secondary by-pass regulation valve 47 and which opens forwardly of the ventilator or fan 43 into the by-pass flow line 40, through which normally flows the major part of the branched-off flue gas by-pass flow which is used for the temperature regulation in the fluidized bed 17.

By means of the two previously discussed by-pass flow regulation circuits and the three by-pass flow regulation valves 31, 32 and 33 in the steam generator 1 as well as by appropriately dosing the cooled flue gases and combustion air branched-off in the injector 37 and in the flue gas/air mixer 44, it is possible to vary and regulate, as the case may be, the steam output over a wide range.

The portion of the flue gases which remains behind the cyclone separator 35 follows the branch-off of the line 39, and naturally, the major part of the flue gases formed in the steam generator 1, after passing an electro-filter 48, from which there is removed the therein separated residual dust by means of a dust withdrawal line 49, arrives by means of a turbine flue gas infeed line 50 for the work output at the gas turbine 4.

As is the case for all steam generators having fluidized bed firing the heating surfaces of the steam system are relatively rapidly contaminated due to the high dust content of the flue gases following the fluidized bed, so that also for this installation there must be provided a suitable cleaning device, for instance operating according to the principle of beating-off the contaminents or the ball jet principle.

The means by virtue of which the objectives of the invention can be realized therefore reside in the three regulation valves 31, 32, 33 in the steam generator 1, the flue gas by-pass lines or line means 39, 40, 46 and the valves 41, 47 provided in such lines as well as the cooler 42 and the ventilator 43. By means of the position of the valves or other equivalent flow control elements, the cooling agent throughput through the cooler or cooling device 42 and the feed or delivery output of the ventilator or fan 43, it is possible to maintain the fluidized bed 17 at a permissible temperature by withdrawing the heat in the cooler 42 while avoiding the drawbacks prevalent with cooling tubes arranged in the fluidized bed, and the heat transmitted to the heating surfaces in the steam boiler can be optimumly accommodated to the momentarily required steam output.

While there are shown and described present preferred embodiments of the invention, it is to be distinctly understood that the invention is not limited thereto, but may be otherwise variously embodied and practiced within the scope of the following claims.

ACCORDINGLY,

What I claim is:

1. In a steam power plant containing a pressure-fired steam generator equipped with fluidized bed firing, a charging set composed of a gas turbine and a compressor, the charging set being driven by the flue gases of the steam generator and conveying the compressed combustion air beneath the fluidized bed in order to form thereat a vortex layer, devices for the separation, filtering and withdrawal of the dust-like contaminants contained in the flue gas and for controlling and regulating the steam output for a steam turbo-generator set, the improvement which comprises:

said steam generator containing boiler heating surfaces;

all of said boiler heating surfaces being arranged externally of the vortex layer of the fluidized bed;

said devices for the control and regulation of the steam output comprising:

by-pass flow regulating valve means for the flue gas;

said by-pass flow regulating valve means being arranged in said steam generator;

a flue gas withdrawal line provided for said steam generator;

a flue gas by-pass line means branching-off said flue gas withdrawal line;

said flue gas by-pass line means containing a flue gas by-pass valve means, a flue gas cooler means and a ventilator means;

said flue gas by-pass line means opening into the steam generator below the fluidized bed;

a secondary flue gas by-pass line for flow communicating a location of the flue gas by-pass line means forwardly of the flue gas by-pass valve means with a location of the flue gas by-pass line means following the flue gas cooler means;

a secondary flue gas by-pass valve means provided for said secondary flue gas by-pass line;

an injector for blowing in solid non-combusted constituents separated out of the flue gas withdrawal line into the fluidized bed;

a flue gas branch means leading frm the flue gas by-pass line means following the ventilator into said injector;

a flue gas/air mixer provided for the flue gas by-pass line means forwardly of a location where it opens below the fluidized bed of the steam generator; and said flue gas/air mixer flow communicating with a branched location leading from a primary air line of said charging set.

* * * * *